US005482491A

United States Patent [19]

Kichijyo

[11] Patent Number: 5,482,491

[45] Date of Patent: Jan. 9, 1996

[54] BLOCK ASSEMBLY

[75] Inventor: Hiroshi Kichijyo, Yoshino, Japan

[73] Assignee: Yoshiritsu Kabushiki Kaisha, Nara, Japan

[21] Appl. No.: 229,775

[22] Filed: Apr. 19, 1994

[30] Foreign Application Priority Data

Apr. 20, 1993 [JP] Japan ..... 5-092969

[51] Int. Cl.[6] ..... A63H 33/08

[52] U.S. Cl. ..... 446/112; 446/120; 446/124

[58] Field of Search ..... 446/111, 112, 446/125, 124, 127, 120, 108, 115, 116, 113; 52/285.1, 285.3, 282.2, 284, 582.1, 584.1, 585.1, 586.1; D21/108

[56] References Cited

U.S. PATENT DOCUMENTS 4,345,762 8/1982 Lebelson ..... 446/127 X
4,529,385 7/1985 Reiner et al. ..... 446/125 X
4,602,908 7/1986 Kroeber ..... 446/124 X

FOREIGN PATENT DOCUMENTS 2596824 10/1987 France ..... 446/125
2251951 11/1973 Germany ..... 446/124

*Primary Examiner*—Mickey Yu
*Attorney, Agent, or Firm*—Wenderoth, Lind & Ponack

[57] ABSTRACT

A block assembly is formed by assembling regular polygonal block plates and columnar joint blocks together. Each regular polygonal block plate has a coupling socket in each side surface thereof. Each joint block, which is brought into contact with one side surface of the block plate, is provided on at least two of its side faces with plugs adapted to detachably fit in the sockets formed in the block plate.

10 Claims, 9 Drawing Sheets

BLOCK ASSEMBLY

BACKGROUND OF THE INVENTION

This invention relates to a block assembly formed by coupling regular polygonal block plates together with joint blocks.

There is known a block assembly which can be assembled by coupling component blocks together. Such a conventional assembly is nothing but a toy.

There is not known a block assembly which can be easily formed into any desired hollow three-dimensional shape with high accuracy and which is structurally stout when assembled.

Conventional block assemblies are therefore not suitable as ornaments for furniture and chandeliers or for other practical applications.

SUMMARY OF THE INVENTION

It is therefore an object of this invention to provide a block assembly which is of practical use.

The block assembly according to this invention comprises regular block plates and polygonal columnar joint blocks coupled to the block plates, the block plates being formed in each side face thereof with a socket, the joint blocks being provided on at least two of the plurality of side faces thereof with plugs detachably engageable in the sockets formed in the block plates.

By coupling a plurality of such regular polygonal block plates together by means of joint blocks having plugs at different positions, it is possible to construct various kinds of three-dimensional block assemblies.

The block plates and joint blocks can be easily coupled together simply by inserting the plugs formed on the sides of the joint blocks in the sockets formed in the sides of the block plates. Once coupled, they are firmly retained in position because their sides are kept in tight contact with each other.

By combining the block plates and the joint blocks according to this invention in various ways, it is possible to build various block assemblies which are structurally stout and thus can be used not only as toys but also as ornaments for furniture and chandeliers or for other practical applications.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

FIGS. 1 through 12 show the first example of the block assembly according to this invention.

Figure 1:
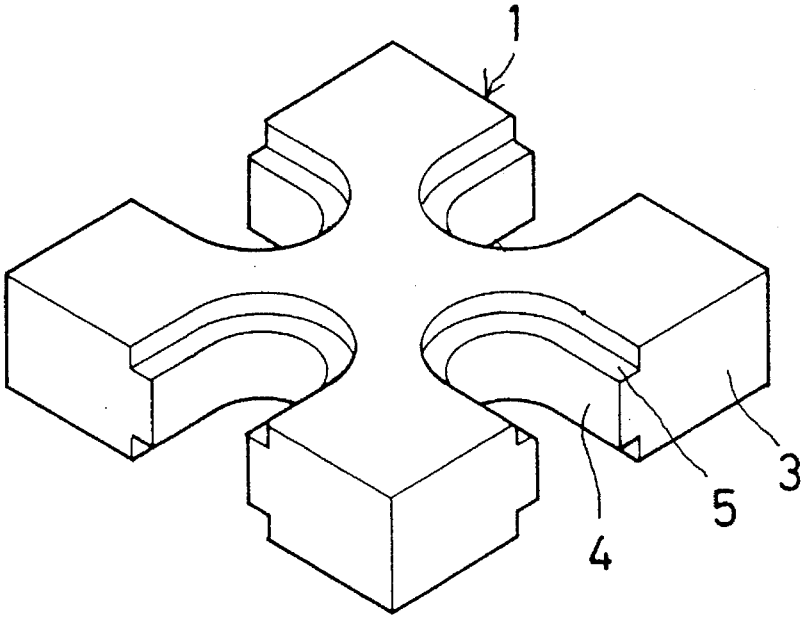
FIG. 1 is a perspective view of one example of the block plate.
Figure 2:
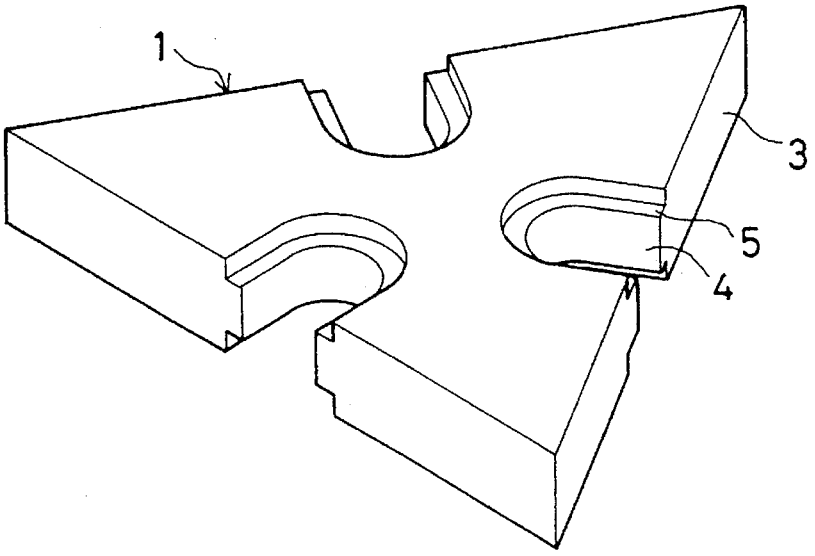
FIG. 2 is a perspective view of another example of the block plate.

FIGS. 1 and 2 show two different kinds of block plates 1 used in this embodiment. FIGS. 3 to 8 show different kinds of joint blocks 2 used in this embodiment.

The block plate 1 shown in FIG. 1 has square top and bottom surfaces and is provided with coupling sockets 4 in its four side surfaces 3.

The block plate 1 shown in FIG. 2 has top and bottom surfaces each in the shape of a regular triangle and is provided with coupling sockets 4 in its three side surfaces 3.

The lengths of the sides and the thicknesses of the block plate 1 of FIG. 2 and of the block plate 1 of FIG. 2 are equal to each other.

The sockets 4 formed in the block plate 1 are U-shaped as viewed from the top and are provided each with a U-shaped central recess, and two grooves extending into the block plate at the top and bottom of the central recess to define shoulders 5, respectively.

Each of the joint blocks 2 shown in FIGS. 3–6 has a columnar portion having a square cross section and has a length equal to the length of each side of the block plate 1. Its four side faces 6, which are adapted to be brought into contact with the side surfaces 3 of the block plates 1 when assembled, have a width equal to the thickness of each block plate 1. The joint block 2 is provided on at least two of the four side faces 6 of the columnar portion with plugs 7 adapted to detachably engage the block plates 1 in the sockets 4.

As viewed from the top, the plugs 7 have the same U shape as the sockets 4. Each plug 7 is formed with a central U-shaped portion adapted to be received in the central recess of a corresponding socket 4, and upper and lower flanges 8 adapted to engage the shoulders 5 of the corresponding socket 4. The plugs 7 have the same thickness as the block plates 1 so that the top and bottom surfaces of the plugs 7 and the block plates 1 will be flush with each other when the plugs 7 are fitted in the sockets 4 of the block plates 1.

Figure 3:
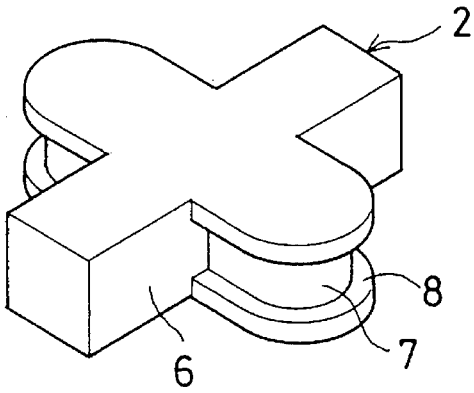
FIGS. 3–8 are perspective views of different examples of the joint block.

The joint block 2 shown in FIG. 3 is provided with one plug 7 on each of two opposite side faces 6.

Figure 4:
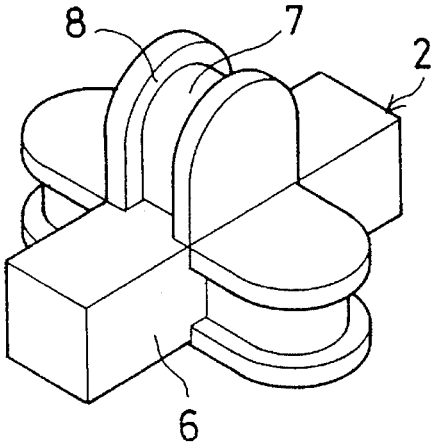
Figure 5:
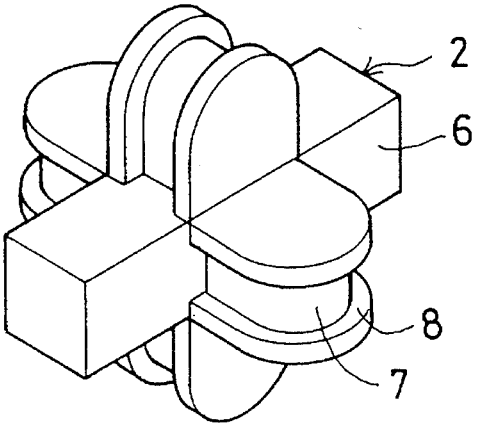

The joint block 2 shown in FIG. 4 has one plug 7 on each of three of its four side faces 6. The joint block 2 shown in FIG. 5 is provided with one plug 7 on each of all of four side faces 6.

Figure 6:
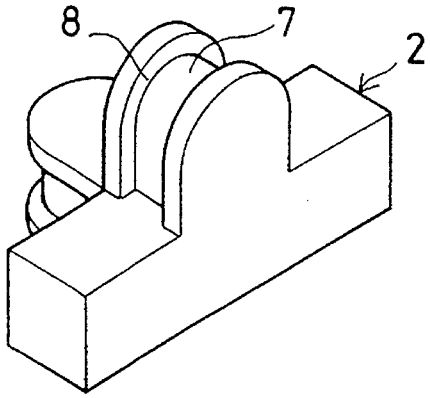

The joint block 2 shown in FIG. 6 is provided with one plug 7 on each of two adjacent sides faces 6 that intersect with each other at a right angle.

Figure 7:
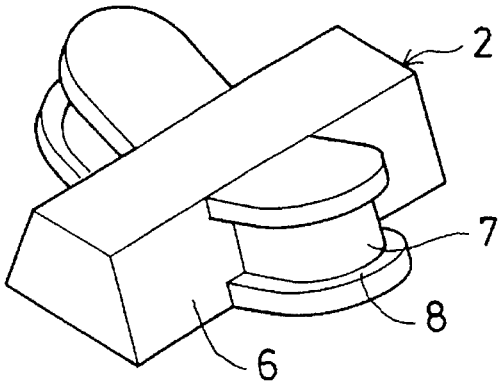
Figure 8:
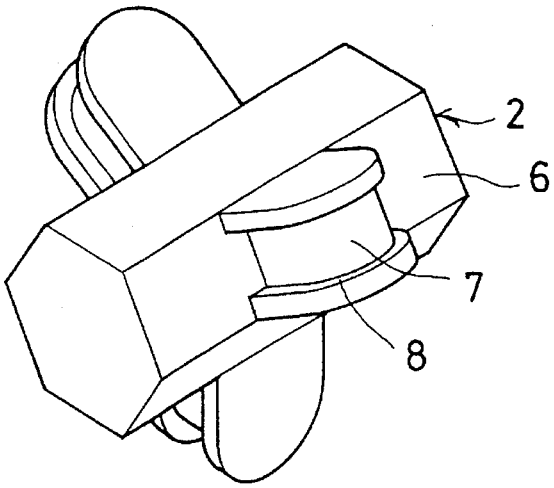
Figure 9:
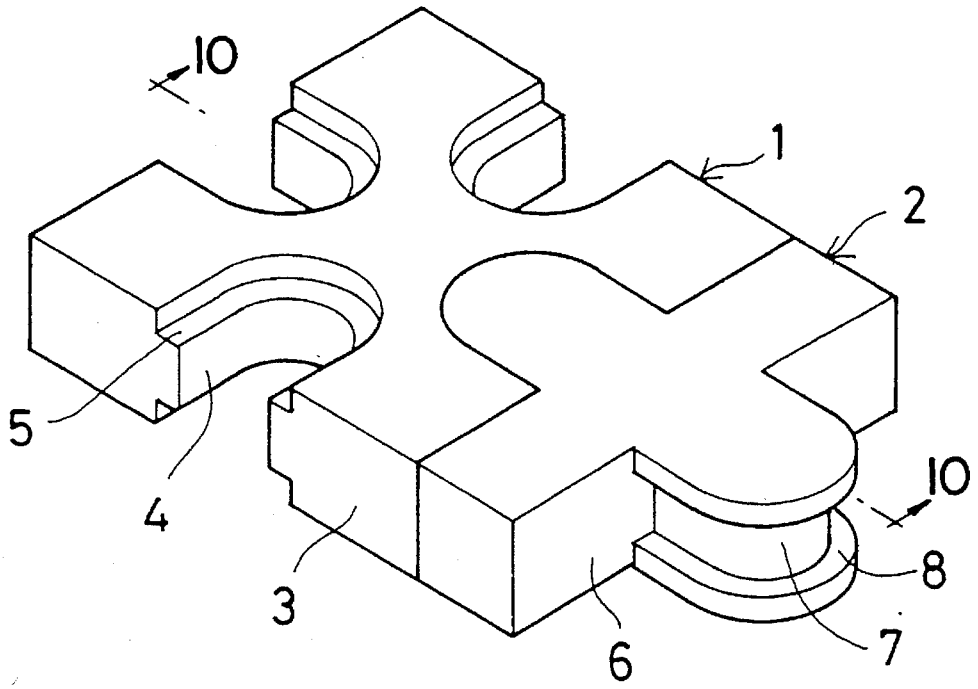
FIG. 9 is a perspective view of the block plate of FIG. 1 coupled to the joint block of FIG. 3.
Figure 10:
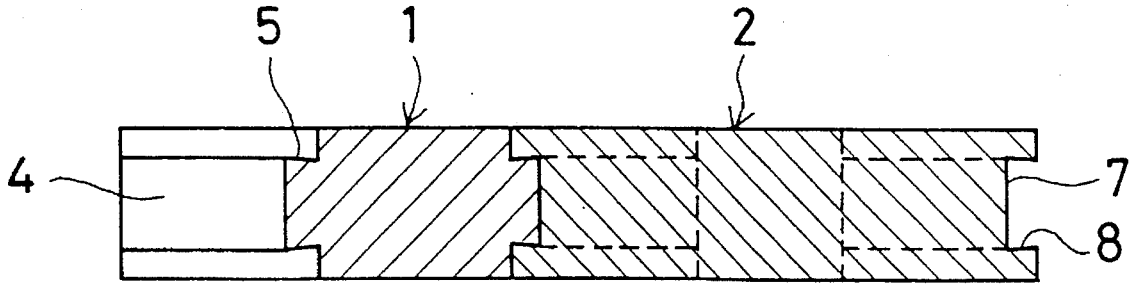
FIG. 10 is a sectional view of the coupled block plate and joint block as taken along line 10—10 of FIG. 9.

FIGS. 7 and 8 show other kinds of joint blocks 2. The joint block 2 of FIG. 7 is used when assembling six square block plates 1 of FIG. 1 into a hexagonal member shown in FIG. 12. Adjacent block plates 1 are coupled together through the joint blocks 2 of FIG. 7 so that the included angle therebetween will be 120°.

The columnar portion of the joint block 2 of FIG. 7 is in the form of a hexagonal prism having a trapezoidal cross section with its sides inclined by 120° with respect to its top surface. Plugs 7 are formed on the inclined side surfaces of the columnar portion. The top surface and both of the side faces have widths equal to each other and to the thickness of the block plate 1.

The columnar portion of the joint block 2 of FIG. 8 has a regular hexagonal cross section. Plugs 7 are provided on alternate one of the six side faces 6. Each side face 6 has a width equal to the thickness of the block plate 1.

Figure 11:
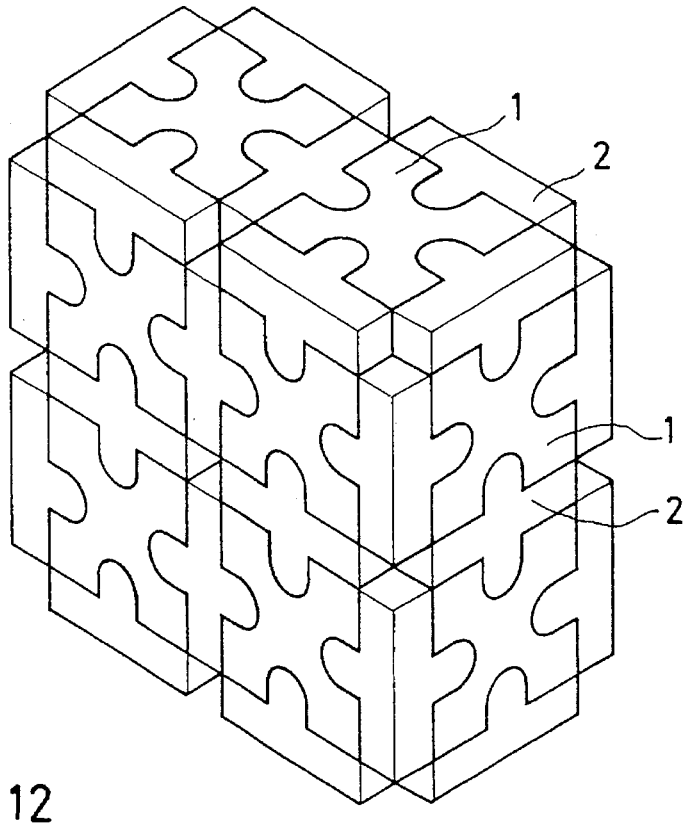
FIG. 11 is a perspective view of an example of the block assembly according to this invention.

FIG. 11 shows a block assembly comprising 16 square block plates 1, 12 joint blocks 2 shown in FIG. 3 which connect the block plates 1 together, and 12 joint blocks 2 shown in FIG. 6 which are provided at the corners of the assembly to connect the side faces together.

Figure 12:
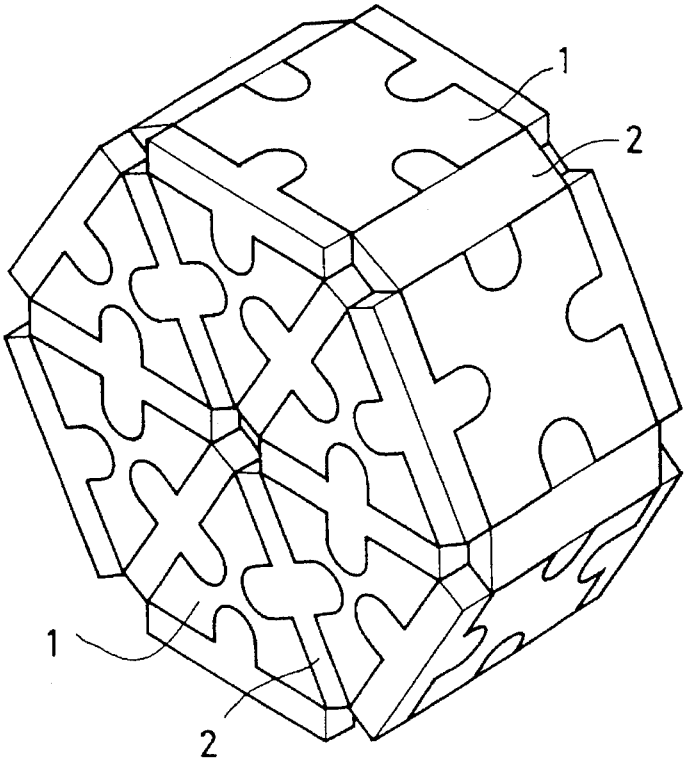
FIG. 12 is a perspective view of another example of the block assembly according to this invention.
Figure 13:
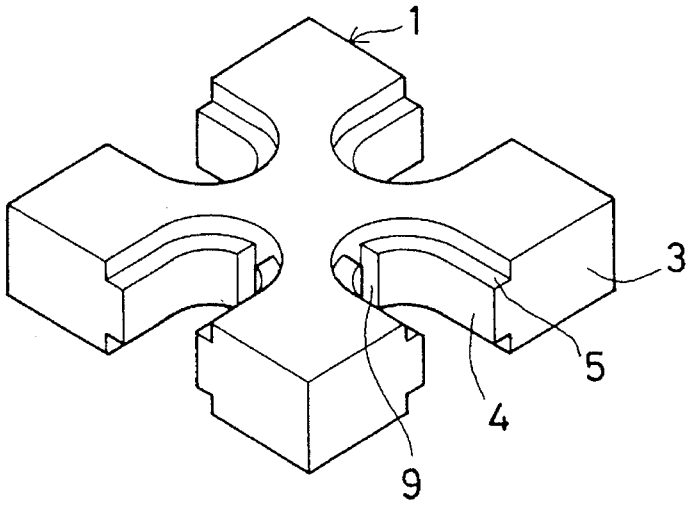
FIG. 13 is a perspective view of another example of the block plate.
Figure 14:
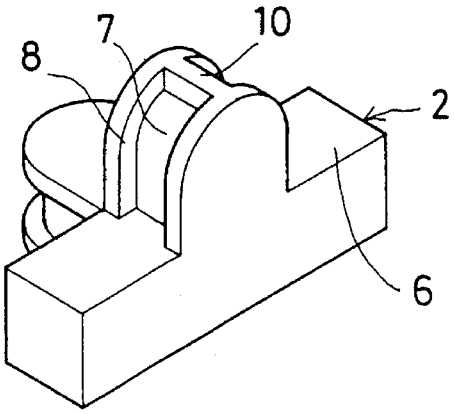
FIG. 14 is a perspective view of another example of the joint block.
Figure 15:
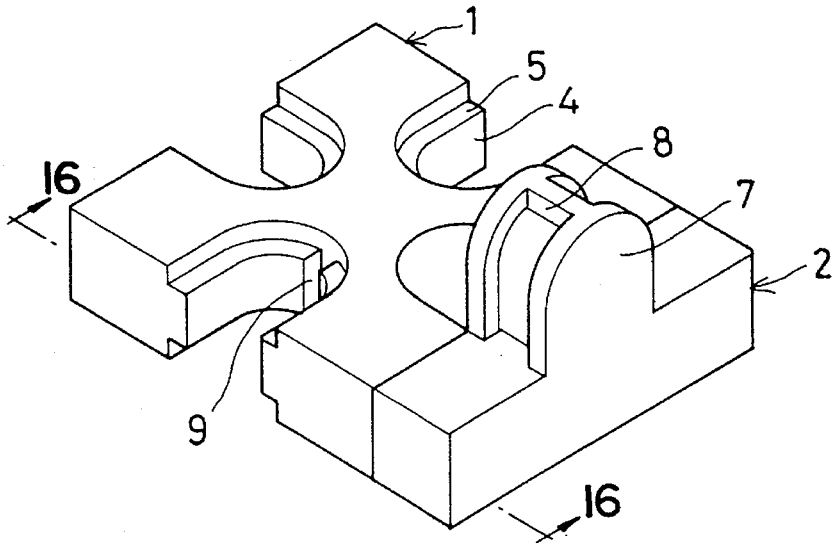
FIG. 15 is a perspective view of the block plate of FIG. 13 coupled to the joint block of FIG. 14.
Figure 16:
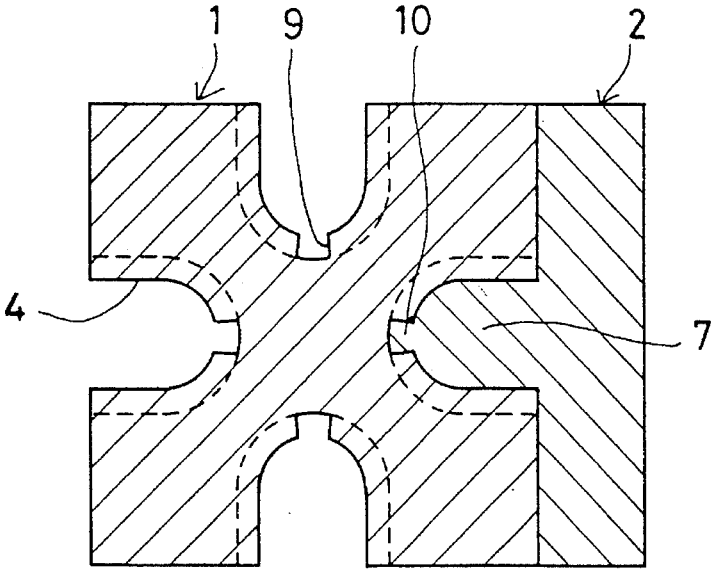
FIG. 16 is a sectional view of the coupled block plate and joint block as taken along line 16—16 of FIG. 15.
Figure 17:
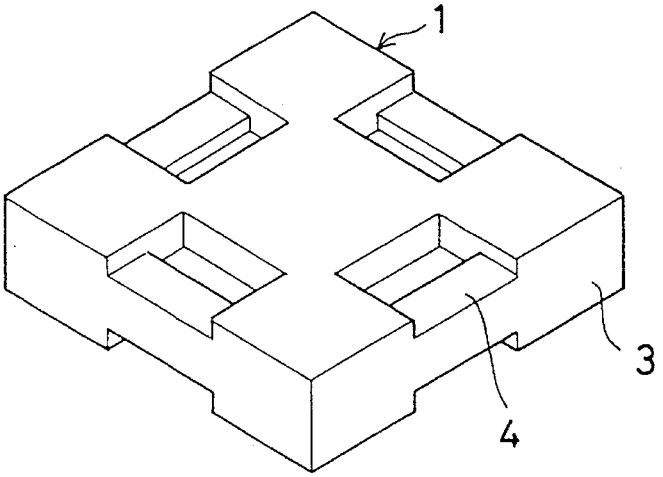
FIG. 17 is a perspective view of another example of the block plate.
Figure 18:
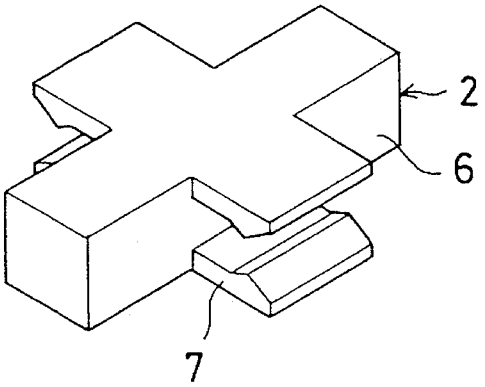
FIG. 18 is a perspective view of another example of the joint block.
Figure 19:
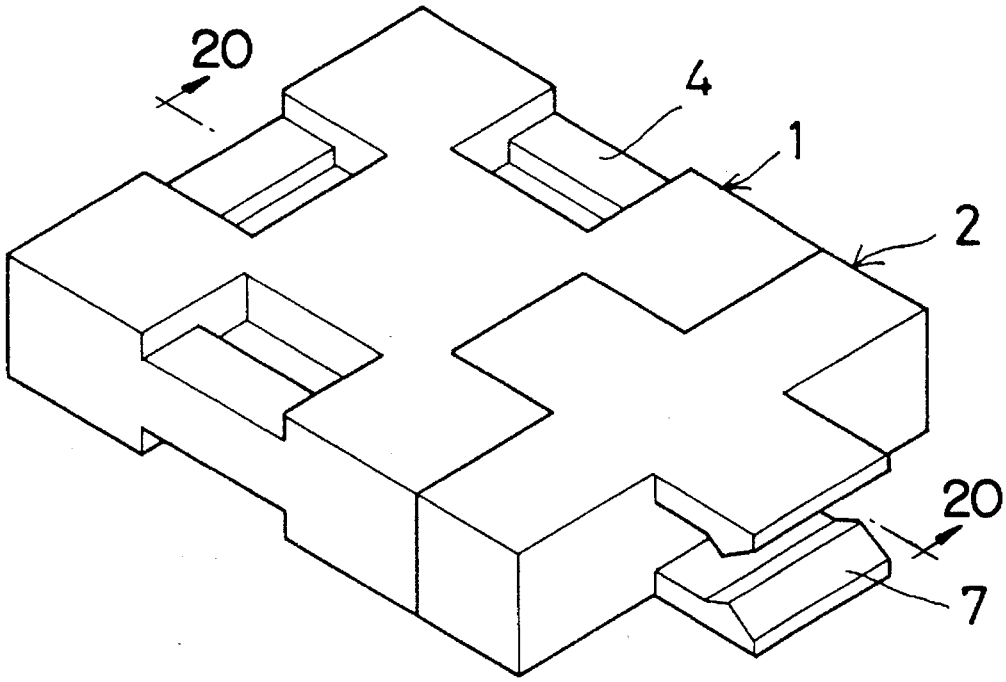
FIG. 19 is a perspective view showing the block plate of FIG. 17 coupled to the joint block of FIG. 18.
Figure 20:
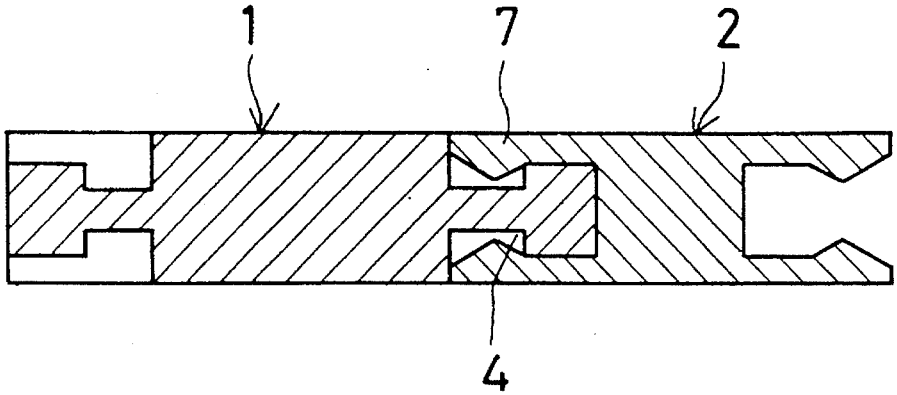
FIG. 20 is a sectional view of the coupled block plate and joint block as taken along line 20—20 of FIG. 19.

The block assembly shown in FIG. 12 comprises a pair of hexagonal flat plate members each comprising six regular triangular block plates 1 and six joint blocks 2 shown in FIG. 3, and a hexagonal prism member disposed between the pair of flat plate members and made up of six square block plates 1 and six joint blocks 2 shown in FIG. 7. The hexagonal flat plate members are coupled to the hexagonal prism member by means of 12 joint blocks 2 shown in FIG. 6.

FIGS. 13–16 show the second embodiment of the block assembly according to this invention.

In this embodiment, the square block plate 1 of the first embodiment is formed, in the deepest central portion of each socket 4, with a vertical groove 9 that extends in the thickness direction. The joint block 2 is provided on top of each plug 7 with a rib 10 adapted to be received in the corresponding groove 9 formed in the block plate 1. By inserting the rib 10 into the groove 9, it is possible to increase the coupling force between the block plate 1 and the joint block 2.

Similar to the first embodiment, the block plates 1 and the joint blocks 2 may be combined in many ways. Since such combinations are the same as in the first embodiment, we show only a square block plate 1 in FIG. 13 and a joint block 2 in FIG. 14.

FIGS. 17–20 show the third embodiment of the block assembly according to this invention.

In this embodiment, each plug 7 of the joint block 2 (FIG. 18) comprises a pair of upper and lower engaging claws. Each socket 4 of the block plate 1 (FIG. 17) comprises two recesses for receiving the respective engaging claws of the joint block 2.

The block plates 1 and the joint block 2 are combined in the same ways as in the first embodiment.

FIGS. 21–25 show the fourth embodiment of the block assembly according to this invention.

Figure 21:
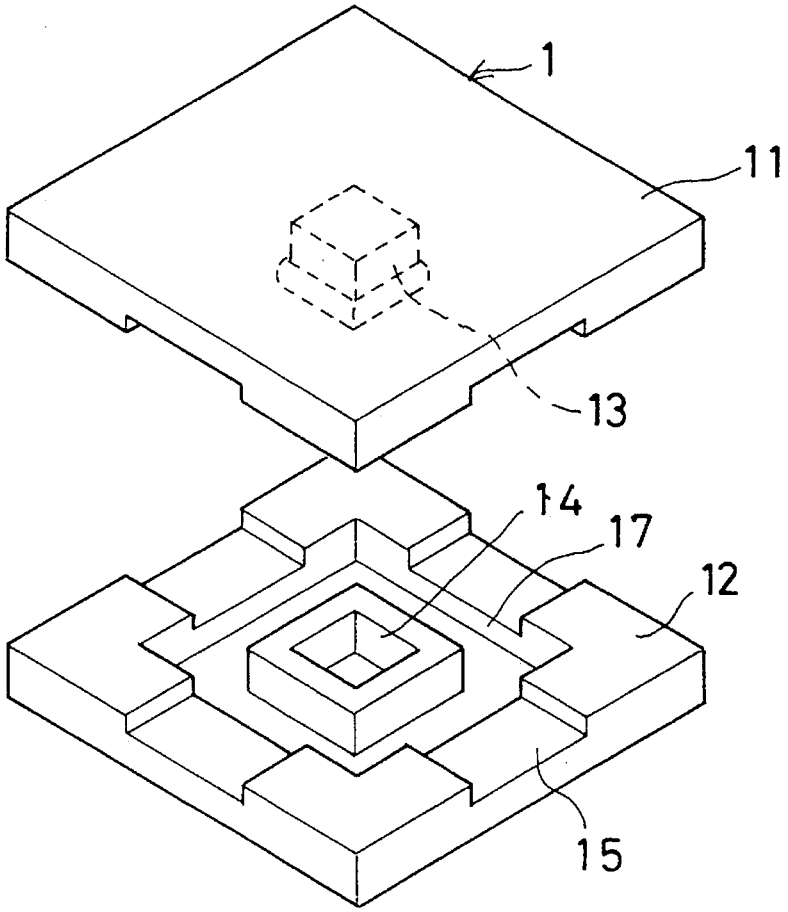
FIG. 21 is an exploded perspective view of another example of the block plate.

In this embodiment, as shown in FIG. 21, the block plate 1 comprises a top plate 11 and a bottom plate 12. The top plate 11 and the bottom plate 12 are provided in the central portions of their opposed surfaces with a protrusion 13 and a recess 14 adapted to receive the protrusion 13, respectively. By inserting the protrusion 13 into the recess 14, the top plate 11 and the bottom plate 12 are coupled together. The protrusion 13 and the recess 14 may be coupled together either by bonding or by an interference fit so that they may not readily separate from each other.

Figure 22:
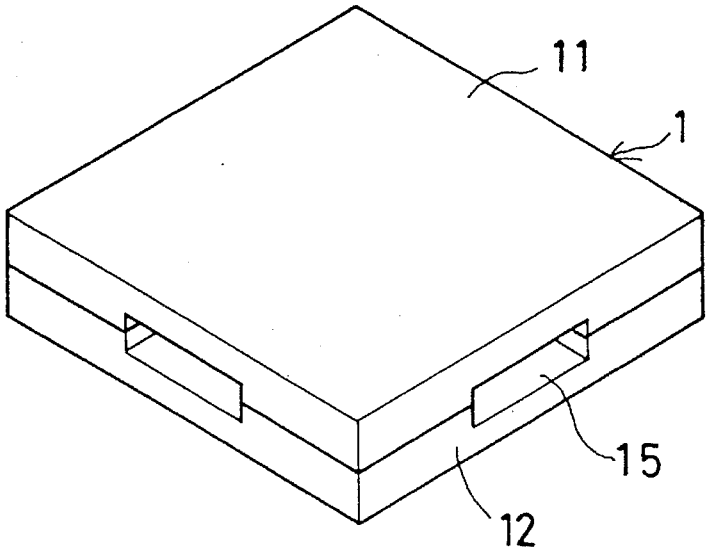
FIG. 22 is a perspective view of the block plate of FIG. 21.
Figure 23:
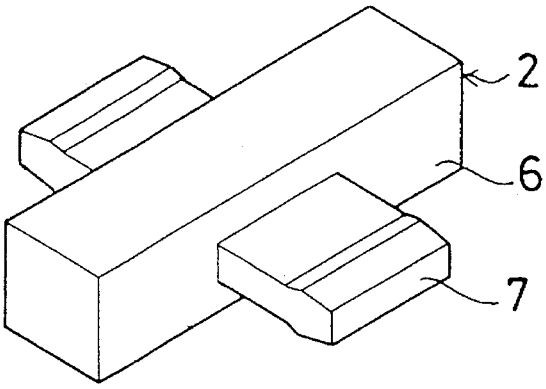
FIG. 23 is a perspective view of another example of the joint block.
Figure 24:
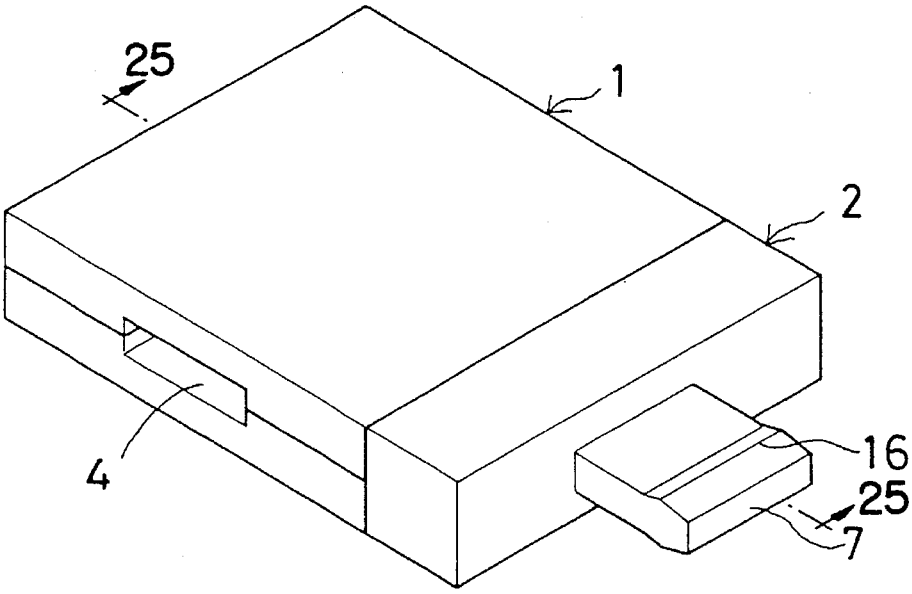
FIG. 24 is a perspective view of the block plate of FIG. 21 coupled to the joint block of FIG. 23.
Figure 25:
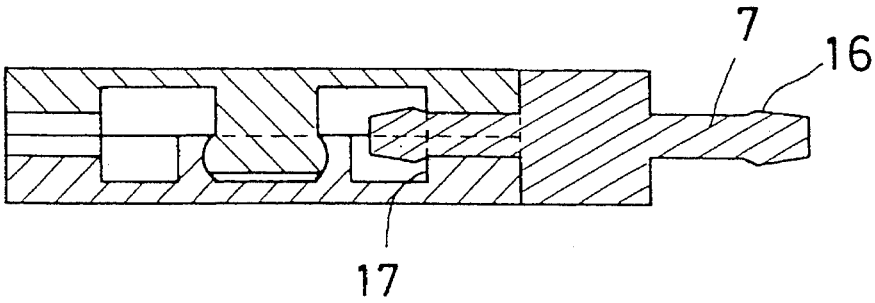
FIG. 25 is a sectional view of the coupled block plate and joint block as taken along line 25—25 in FIG. 24.

The top and bottom plates 11 and 12 are formed with cutouts 15 in their opposed surfaces along the four side edges. When they are joined together as shown in FIG. 22, sockets 4 are formed by the cutouts 15. Each plug 7 of the joint block 2 is a flat plate having its free end bulged as at 16 (FIG. 23). Inside the cutouts 15, the top and bottom plates 11 and 12 are formed with engaging grooves 17 (FIG. 21) adapted to receive the bulged portion 16 of each plug 7.

In this embodiment, too, the block plates 1 and the joint blocks 2 are combined in the same ways as in the first embodiment.

The block plates 1 and the joint blocks 2 of any of the above embodiments may be made from synthetic resin or any other desired material. Also they may be painted in any desired color according to the intended use of the assembled member.

What is claimed is:

1. An assembly of blocks comprising: a plurality of block plates, and a plurality of joint blocks coupling said block plates together, each of said block plates having polygonal top and bottom surfaces, at least three side surfaces each extending between said top and bottom surfaces, and a respective socket in each of said side surfaces, each said socket being constituted by a central recess extending into the block plate from a said side surface and two grooves extending into the block plate at locations above and beneath said central recess, respectively, said two grooves defining shoulders above and beneath said central recess, respectively, the thicknesses of said block plates, as taken between said top and bottom surfaces thereof, respectively, being equal, and the lengths of the side surfaces of said block plates being equal, and each of said joint blocks including a columnar portion having a plurality of side faces, and a respective plug extending from each of at least two of said side faces, each of said plugs having a central portion having a shape complementary to that of a said central recess, and upper and lower flanges disposed above and beneath said central portion, respectively, said flanges having shapes complementary to those of said two grooves, respectively, each of said side faces having a length equal to the length of each of the side surfaces of said block plates and a width equal to the thickness of each of said block plates.

2. An assembly as claimed in claim 1, wherein some of said block plates each have regular triangular top and bottom surfaces, and others of said block plates each have square top and bottom surfaces.

3. An assembly as claimed in claim 2, wherein the columnar portion of each of at least some of said joint blocks has a square cross section.

4. An assembly as claimed in claim 3, wherein the columnar portion of each of others of said joint blocks has a trapezoidal cross section, the side faces of each of said others of said joint blocks consisting of parallel top and bottom surfaces and side surfaces each intersecting the top surface of said parallel surfaces at an angle of 120°, the plugs of each of said others of said joint blocks consisting of two plugs extending from said side surfaces of the joint block, respectively.

5. An assembly as claimed in claim 1, wherein the columnar portion of at least some of said joint blocks has a regular hexagonal cross section so as to have six said side faces, and the plugs of each of said at least some of said joint blocks consist of three plugs extending from alternate ones of said six side faces.

6. An assembly as claimed in claim 1, wherein each of the central recesses of said plate blocks and each of the central portions of the plugs of said joint blocks is U-shaped.

7. An assembly as claimed in claim 2, wherein each of the central recesses of said plate blocks and each of the central portions of the plugs of said joint blocks is U-shaped.

8. An assembly as claimed in claim 3, wherein each of the central recesses of said plate blocks and each of the central portions of the plugs of said joint blocks is U-shaped.

9. An assembly as claimed in claim 4, wherein each of the central recesses of said plate blocks and each of the central portions of the plugs of said joint blocks is U-shaped.

10. An assembly as claimed in claim 5, wherein each of the central recesses of said plate blocks and each of the central portions of the plugs of said joint blocks is U-shaped.

* * * * *